US010520160B2

(12) United States Patent
Horne et al.

(10) Patent No.: US 10,520,160 B2
(45) Date of Patent: Dec. 31, 2019

(54) COLLAPSIBLE MULTI-FUNCTIONING LIGHTING DEVICE COMPRISING CONCENTRIC RINGS HAVING DIFFERENT RADII INTERCONNECTED BY A FLEXIBLE MEMBRANE

(71) Applicant: Alliance Sports Group, L.P., Fort Worth, TX (US)

(72) Inventors: Gregory Lee Horne, Euless, TX (US); Jimmy Prieto, Fort Worth, TX (US); Todd Marcucci, Mansfield, TX (US)

(73) Assignee: Alliance Sports Group, L.P., Fort Worth, TX (US)

( * ) Notice: Subject to any disclaimer, the term of this patent is extended or adjusted under 35 U.S.C. 154(b) by 0 days.

(21) Appl. No.: 16/278,978

(22) Filed: Feb. 19, 2019

(65) Prior Publication Data

US 2019/0257479 A1 Aug. 22, 2019

Related U.S. Application Data

(60) Provisional application No. 62/633,177, filed on Feb. 21, 2018.

(51) Int. Cl.
*F21K 9/237* (2016.01)
*F21V 1/06* (2006.01)
(Continued)

(52) U.S. Cl.
CPC ..... *F21V 1/06* (2013.01); *F21K 9/235* (2016.08); *F21K 9/237* (2016.08); *F21L 4/04* (2013.01);
(Continued)

(58) Field of Classification Search
CPC ..... F21Y 2115/10; F21V 1/06; F21V 21/22; F21V 21/145; F21K 9/237; F21K 9/235; F21L 4/04
See application file for complete search history.

(56) References Cited

U.S. PATENT DOCUMENTS 6,062,701 A * 5/2000 Hines ..... A47G 33/06 362/123
6,688,757 B2 * 2/2004 Kovach ..... F21V 7/18 362/278
(Continued)

FOREIGN PATENT DOCUMENTS

JP 2003/346523 A 12/2003
KR 20-2010/0006084 U 6/2010
KR 101520286 B1 5/2015

OTHER PUBLICATIONS

PCT Application No. PCT/US2019/018533; Filing Date Feb. 19, 2019; Gregory Lee Horne, International Search Report; dated May 30, 2019; 9 Pages.

*Primary Examiner* — Robert J May
(74) *Attorney, Agent, or Firm* — Thorpe North & Western LLP

(57) ABSTRACT

A collapsible multi-functioning lighting device is disclosing having a plurality of concentric casings interconnected by a flexible membrane, the plurality of casings have at least first and second configurations. The first configuration is a collapsed configuration wherein each of the plurality of interconnected concentric casings form a nested group of concentric casings. The second configuration comprises an extended configuration wherein the plurality of concentric casings and flexible membrane form (i) continuous sidewalls, (ii) an open end, and (iii) a closed end that all define an internal volume. A light source is disposed in the closed end.

20 Claims, 6 Drawing Sheets

(51) Int. Cl.

| | |
|---|---|
| ***F21V 21/14*** | (2006.01) |
| ***F21K 9/235*** | (2016.01) |
| ***F21L 4/04*** | (2006.01) |
| ***F21V 21/22*** | (2006.01) |
| *F21Y 115/10* | (2016.01) |

(52) U.S. Cl.
CPC ..... *F21V 21/145* (2013.01); *F21V 21/22* (2013.01); *F21Y 2115/10* (2016.08)

(56) References Cited

U.S. PATENT DOCUMENTS

| | | | | |
|---|---|---|---|---|
| 6,981,785 | B1 * | 1/2006 | Watchulonis ..... | F21V 1/06 362/352 |
| 8,033,694 | B2 | 10/2011 | Fett et al. | |
| 2014/0103036 | A1 | 4/2014 | Perlman | |
| 2016/0290605 | A1 | 10/2016 | Itzhak et al. | |

* cited by examiner

COLLAPSIBLE MULTI-FUNCTIONING LIGHTING DEVICE COMPRISING CONCENTRIC RINGS HAVING DIFFERENT RADII INTERCONNECTED BY A FLEXIBLE MEMBRANE

PRIORITY CLAIM

The present application claims priority to U.S. Ser. No. 62/633,177 filed on Feb. 21, 2018 entitled "Collapsible Multi-Functioning Lighting Device" which is incorporated herein by reference in its entirety.

FIELD OF THE INVENTION

The present invention relates generally to lighting devices, systems, and associated methods and more particularly to an improved apparatus and system for providing utilitarian light.

BACKGROUND

Illuminated carriers can be used at Halloween or other events or in connection with other utilitarian activities like fishing. The carriers may provide illumination of the interior or exterior of the carrier. The carriers, however, take up unnecessary space and have limited utility. There is a need for a carrier with numerous configurations of operation, including functioning as an independent lighting device as well as a lighted carrier.

BRIEF DESCRIPTION OF THE DRAWINGS

The present technology will become more fully apparent from the following description and appended claims, taken in conjunction with the accompanying drawings. Understanding that these drawings merely depict exemplary aspects of the present technology they are, therefore, not to be considered limiting of its scope. It will be readily appreciated that the components of the present technology, as generally described and illustrated in the figures herein, could be arranged and designed in a wide variety of different configurations. Nonetheless, the technology will be described and explained with additional specificity and detail through the use of the accompanying drawings in which:

DESCRIPTION OF EMBODIMENTS

Figure 1A:
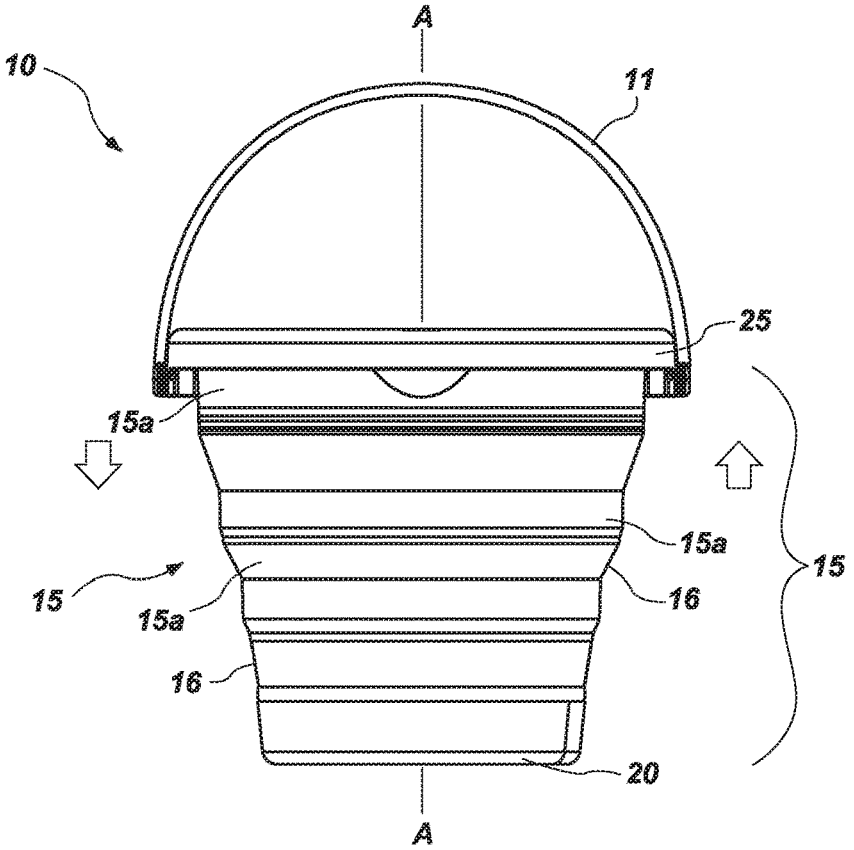
FIG. 1A is a side view of a collapsible container in an extended configuration in accordance with one aspect of the technology.

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order.

It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Reference in this specification may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

EXAMPLE EMBODIMENTS

An initial overview of technology embodiments is provided below and specific technology embodiments are then described in further detail. This initial summary is intended to aid readers in understanding the technology more quickly, but is not intended to identify key or essential features of the technology, nor is it intended to limit the scope of the claimed subject matter.

Broadly speaking, aspects of the disclosed technology operate to create a unique and improved configuration for utilitarian light associated with a collapsible bucket, cup, or other container configured to carry material therein. In an extended configuration the collapsible container is "open" such that an open volume is created within the container. In a collapsed or "closed" configuration, the container is collapsed on itself so that it is substantially flat. In one aspect of the technology, the container collapses or "opens and closes" in an axial direction along a longitudinal axis extending through a center of the container (shown along line A-A in FIG. 1A). A bottom of the container comprises a light source configured to project light outward and away from a bottom of the container and/or inward and towards an inner volume of the container. In its different operational modes, the light source operates to illuminate an area beneath a bottom of the container in a first mode or, in a second mode to illuminate an area within the container. In the second mode, when a top or open end of the container is occluded and the sidewalls of the container are translucent, the container can operate as a lamp. In the second mode, when the open end of the container is not occluded, the container can operate as a spotlight. In an aspect where the sidewalls are not substantially translucent, the direction of light in a forward direction is enhanced as light is not lost through the sidewalls of the container. In an aspect where the container is in a collapsed configuration, either in a first mode or a second mode, the collapsed container can operate as a flood light.

With reference generally now to FIGS. 1A through 1E, a collapsible container 10 is shown in various operational states. In accordance with one aspect of the technology, the container 10 generally includes a flexible peripheral side wall 15 or membrane, a lower casing 20, and an upper casing 25. The peripheral side wall or flexible membrane 15 is coupled to the lower casing 20 and upper casing 25. The peripheral side wall 15 is formed to include a plurality of flexible portions of substantially equal axial length (though different lengths could be used). The plurality of flexible portions has a minimum side wall thickness ranging from about 30 to 40 mils. The maximum thicknesses of these portions may be greater depending on the desired amount of rigidity. An exemplary thickness for side wall portions may be, for example, at least about 60 mils and in one aspect in the range of about 30 to 90 mils. The lower casing 20 comprises a rigid (or semi-rigid) ring coupled to the side wall 15 at a top of the casing 20. The upper casing 25 likewise comprises a rigid (or semi-rigid) ring coupled to the side wall 15 at a bottom of the upper casing 25. While the side wall portions are flexible (in certain aspects of the technology), the top and bottom casings are rigid. This arrangement facilitates collapse, extension, and re-collapse of the container as well as practical use of the container as both a lighting device and a utilitarian container for carrying cargo. While reference is made to rings, it is understood that the term casing comprises any number of different shapes (e.g., oval, rectangle, square, etc.) that can be coupled together or interconnected to form a collapsed or nested configuration or extended to form a container.

In one aspect of the technology, a handle 11, is coupled to the upper casing 25 of the container. The handle 11 may be coupled to an interior of the upper casing 25 so that when the container 10 is in a collapsed configuration, the handle 11 can be enclosed within the interior perimeter of the top case 25. In another aspect of the technology, the handle 11 is coupled to an exterior of the upper casing 25 so that when the container 10 is in a collapsed configuration, the handle 11 is disposed about an exterior of the upper casing 25 (see, e.g., 1C). In that aspect, the handle 11 may be used to hang the collapsed container 10 on a wall or some other vertical surface in a manner where the bottom of the container 10 is facing outward and away from the vertical surface. The handle 11 may also be used as a stand, to position the collapsed container on a horizontal surface to provide light to a work space or some other area where light is desired. In one aspect of the technology, the handle 11 operates as a ratchet stand, capable of moving to different positions, for providing different stand positions. When the container 10 is in a collapsed configuration and the light is not in use, the ratchet handle 11 will be in a closed position as shown for example in FIG. 1C. When the light is in use, the ratchet stand can be moved to the desired position for positioning the light source on the zone of the work area. For example, the ratcheting stand 11 may rotate 180 degrees to carry the container 10 or to place the container in a hanging position to illuminate a work area. The ratcheting mechanism includes a handle end having a ratchet end and a rotating end. The ratchet end includes a gear member, preferably having a plurality of teeth, for providing a plurality of different positions for the handle 11. In one aspect, there is a spring and ball bearing formed in the ratchet to allow for ratcheting of the handle.

Figure 1B:
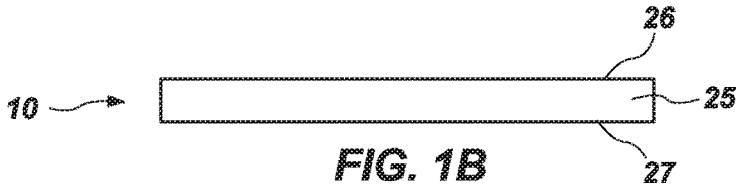
FIG. 1B is a side view of a collapsible container in a collapsed configuration in accordance with one aspect of the technology.
Figure 1C:
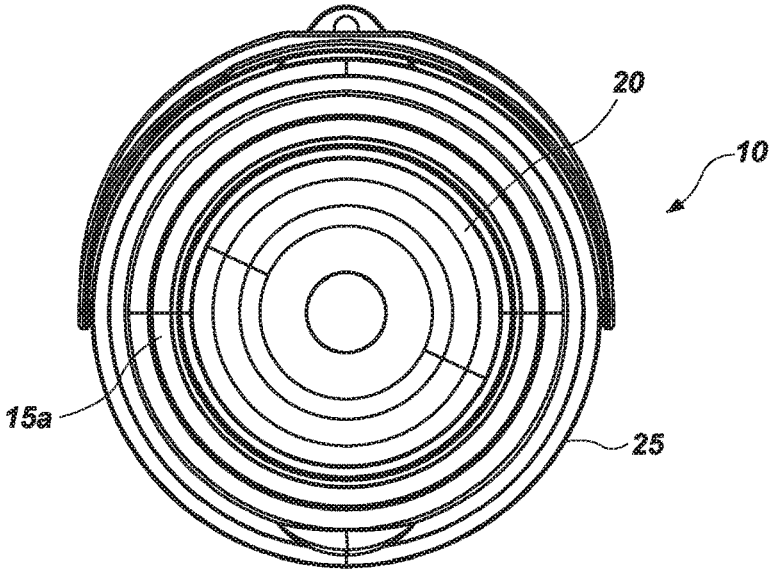
FIG. 1C is a top view of a collapsible container in a collapsed configuration in accordance with one aspect of the technology.
Figure 1D:
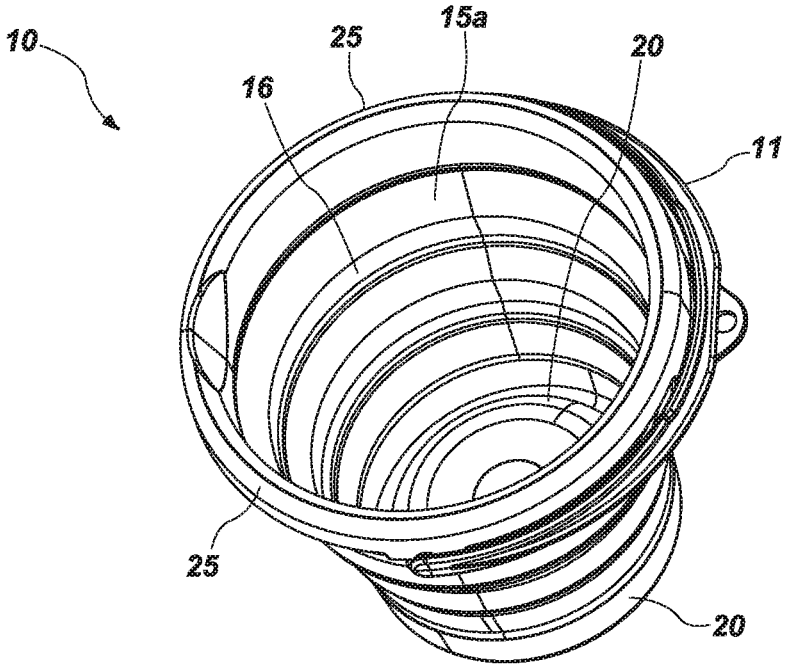
FIG. 1D is a top perspective view of a collapsible container in an extended configuration in accordance with one aspect of the technology.

In order to achieve the telescoping action which enables collapse, expansion and re-collapse of the container 10, the plurality of side walls 15 have, in one aspect, slightly reduced, respective diameters from top to bottom. It should be noted that reference is made to the "diameters" of the various side wall portions for those instances where the containers are substantially round. For other cross-section shapes (e.g., rectangular), it is more appropriate to refer to "cross-sectional areas" or internal perimeter of the respective side wall portions. For purposes of convenience, round containers are described but the technology embraces other container shapes as well. In one aspect of the technology, the plurality of side wall portions 15*a* may be separated by transitional steps or flexible transitional members 16. The transitional steps 16 comprise a radially outwardly flared portion which serves as a guide as an upper side wall portion is reverse folded into an adjacent lower side wall portion. The sidewalls 15 and transitional steps 16 form a continuous sidewall. FIG. 1A generally shows a side view of the collapsible container 10 in an extended configuration. FIG. 1B shows a side view of the collapsible container 10 in a collapsed configuration. FIG. 1 C shows a top view of the collapsible container 10 in a collapsed configuration and FIG. 1D shows a top perspective view of the collapsible container 10 in an extended configuration with the handle 11 disposed on a side of the container.

In one aspect of the technology, the sidewall portions 15 and transitional steps 16 comprise a translucent material (e.g., blow molded or extruded polyester or polyethylene) configured to transmit a portion of light emanating from within the container 10 through the sidewalls 15. In this aspect, the sidewall portions 15 may be made of different colored materials to appeal to the desires of the end user. For example, the sidewall portions may be colored orange to appeal to the Halloween user. In another aspect of the technology, the sidewalls 15 (either a portion or the entire sidewall) comprise an opaque material. In that aspect, the inner side of sidewalls 15 (either a portion or in their entirety) comprises a reflective surface to enhance the propagation of light out of the container 10 when in an extended configuration.

Figure 1E:
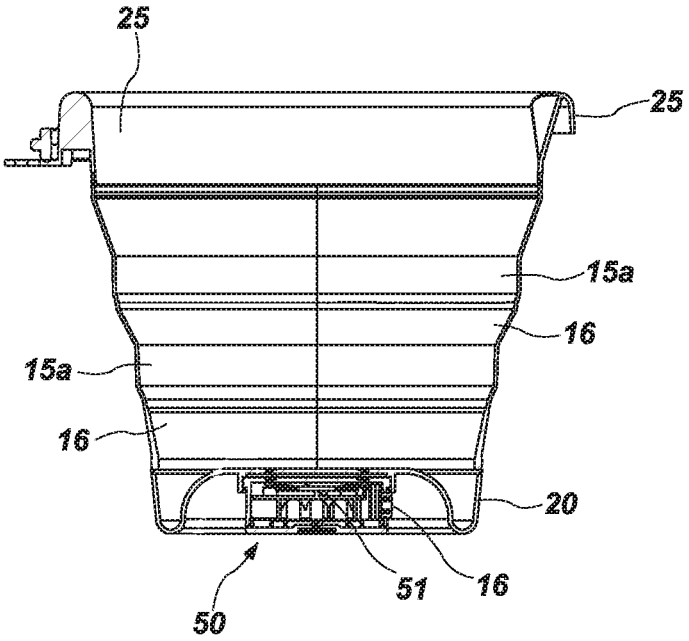
FIG. 1E is a cross-sectional side view of a collapsible container in an extended configuration in accordance with one aspect of the technology.
Figure 2A:
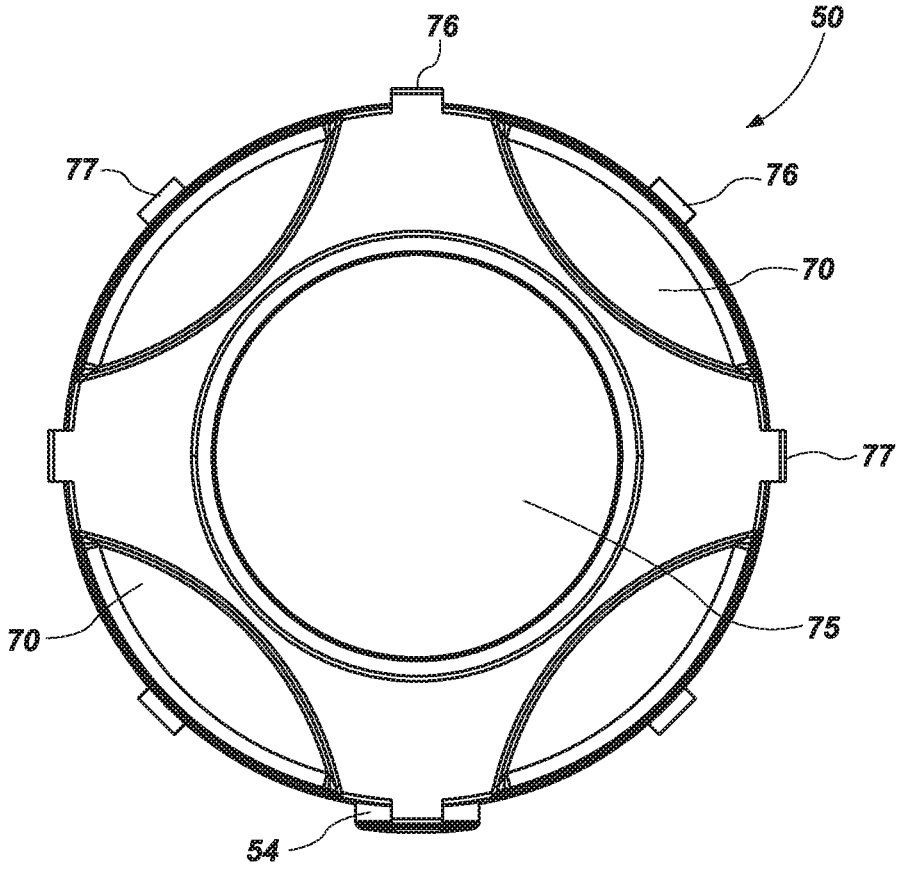
FIG. 2A is a top view of a removable/reversible lighting device in accordance with one aspect of the technology.
Figure 2B:
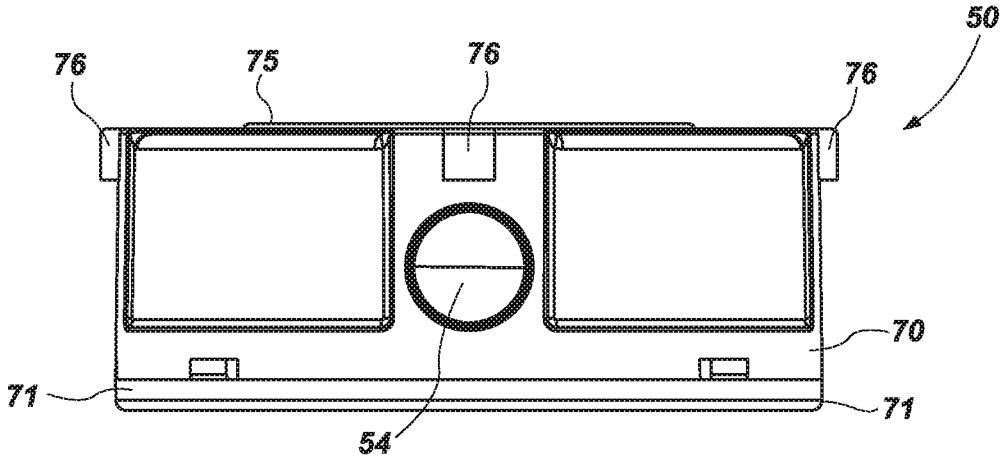
FIG. 2B is a side view of a removable/reversible lighting device in accordance with one aspect of the technology.
Figure 2C:
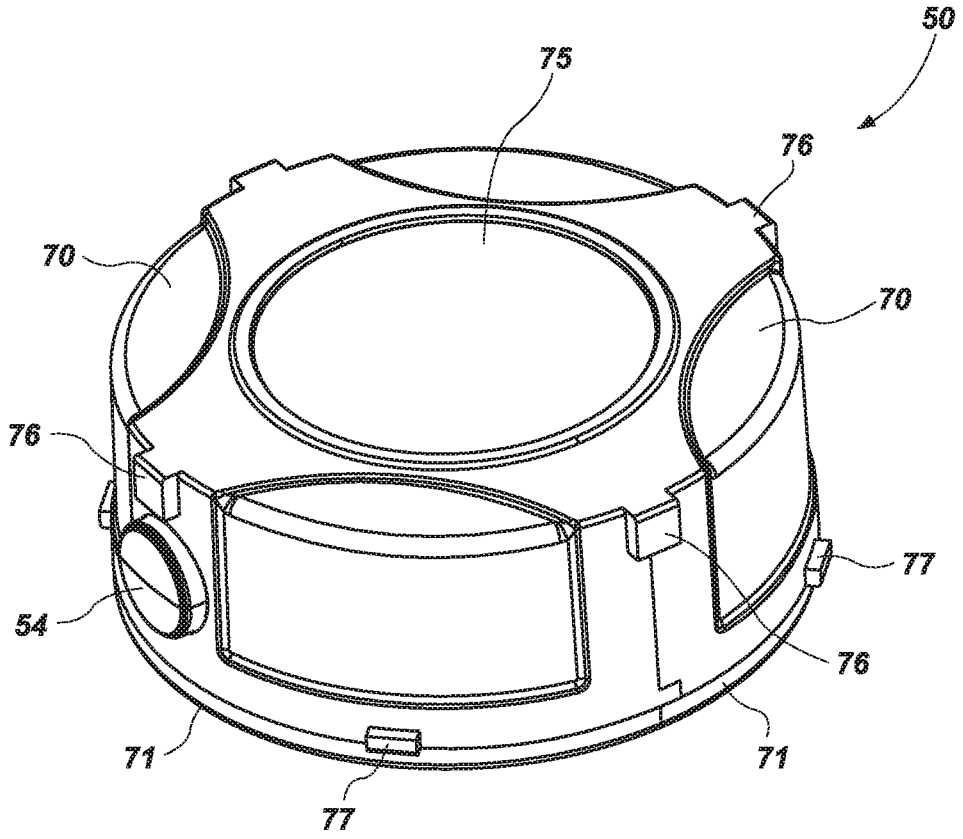
FIG. 2C is a top perspective view of a removable/reversible lighting device in accordance with one aspect of the technology.
Figure 2D:
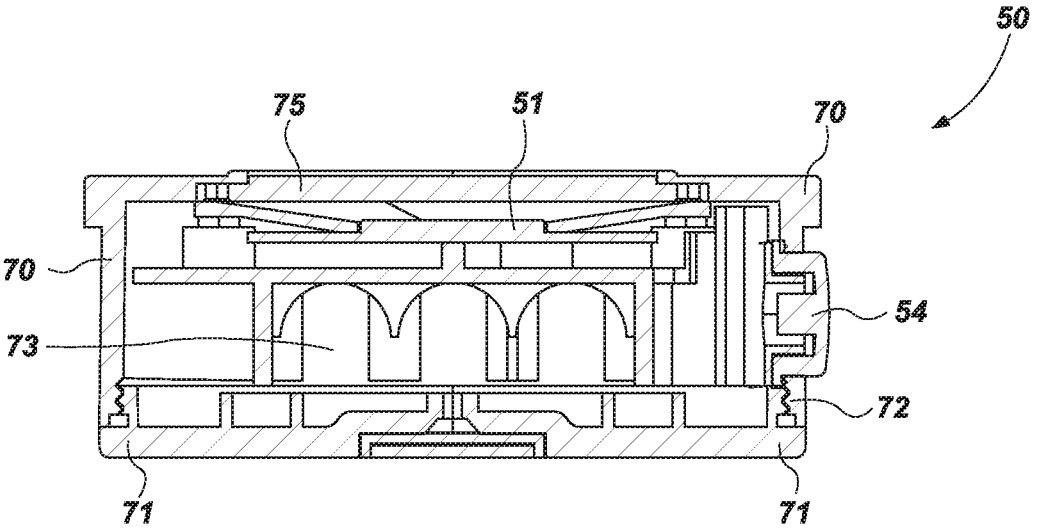
FIG. 2D is a cross-sectional side view of a removable/reversible lighting device in accordance with one aspect of the technology.

With reference to FIG. 1E generally, in one aspect of the technology, a bottom of the collapsible container 10 comprises a removable light source 50. In one aspect of the technology, the removable light source 50 comprises a circular disk or puck 50 with one or more light emitting diodes (LED) 51 disposed about a first side of the disk 50. A power switch 16 is disposed on an opposing side of the disk 50 and is coupled to a power source (e.g., a battery) housed within the disk 50. In one aspect of the technology, the power switch 16 is coupled to a circuit assembly for controlling the transmission of power from the power source to the LEDs 51. In one aspect, the circuit assembly is configured to switch between different LED 51 operational modes. For example, the LED(s) may be in a high mode or a low mode where the respective output from the LED(s) is decreased between modes. The LED(s) 51 may also be switched between a constant or strobe function. In one aspect of the technology, one or more LED(s) 51 may have different color outputs to enable the user to propagate different colors of light as suits a particular application. In one aspect of the technology, one or more LED(s) 51 may comprise a conventional white light spectrum and one or more LED(s) 51 may operate in the red spectrum. The user may use the white spectrum for general lighting purposes. However, in an emergency situation, the user may switch the lighting operation to a strobing red function.

Figure 3:
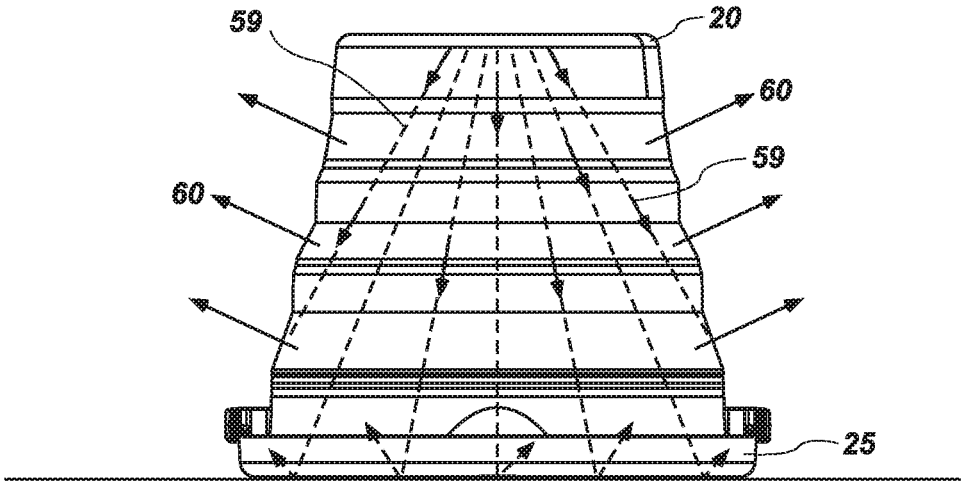
FIG. 3 is a side view of a collapsible container in an extended configuration in accordance with one aspect of the technology.
Figure 4:
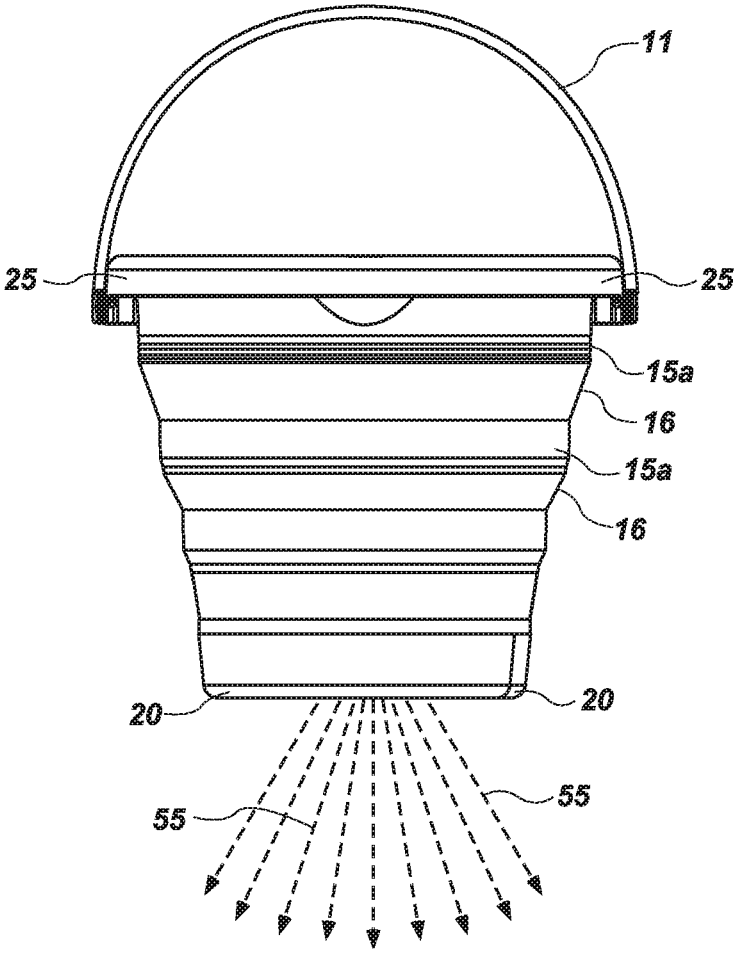
FIG. 4 is a side view of a collapsible container in an extended configuration in accordance with one aspect of the technology.
Figure 5:
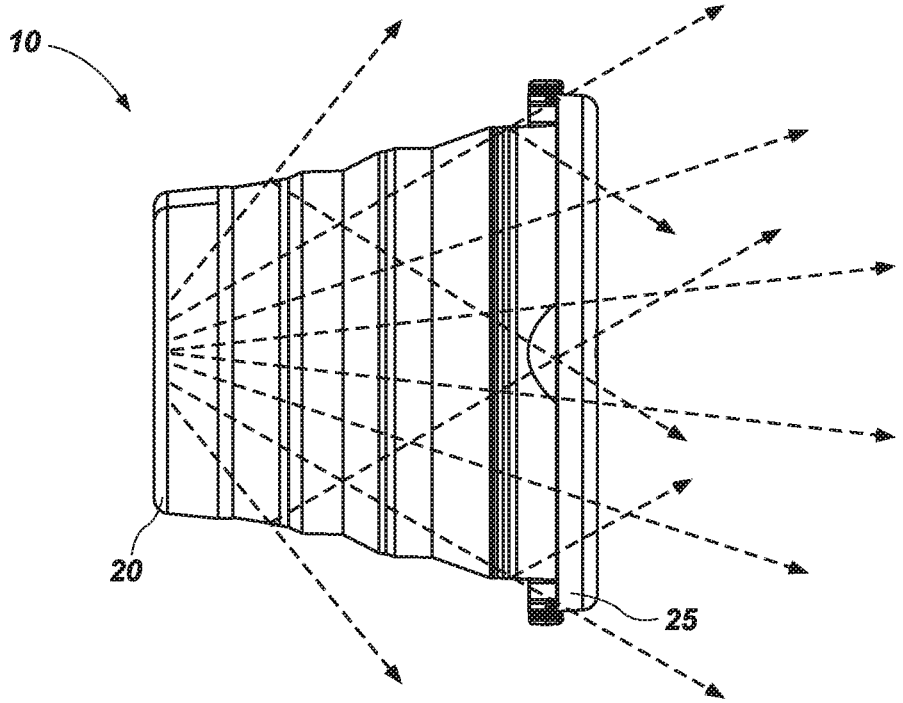
FIG. 5 is a side view of a collapsible container in an extended configuration in accordance with one aspect of the technology.

With reference to FIGS. 3 through 6 (and generally to FIGS. 2A through 2D), different configurations and operational modes of the lighted collapsible container 10 are shown. Shown in FIG. 3, in accordance with one aspect of the technology, the container 10 is in an extended configuration. Disk 50 is configured in this aspect so that the LED(s) 51 of the disk 50 are oriented towards the internal volume of the container 10. In this configuration, the container 10 is usable as a spotlight as shown in FIG. 5 or as a lantern as shown in FIG. 3 when the open top side of the container 10 is occluded. In the aspect shown on FIG. 3, the open top side of the container is placed against a flat or occluding (i.e., it does not necessarily need to be flat) surface (such as a table top, the hood of a car, or a lid). The flat or occluding surface reflects light emitted 59 from the LED(s) 51 and any light reflected from the sidewalls 15 back outward towards the sidewalls 15 creating a lantern effect. The amount of light emitted 60 through the sidewalls 15 is regulated through a dimming function directly associated with the LED(s) 51 as referenced above and/or through varying the amount of sidewall 15 exposed. In other words, a user may decrease the amount of light emanating from the sidewalls 15 when the container 10 is in a "lantern" mode (i.e., FIG. 3) by partially collapsing the container 10. For example, in one aspect where the container sidewalls 15 comprise three separate concentric (but diametrically different) sidewall portions, each sidewall portion may be three inches tall so that the entire sidewall 15 is approximately 9 inches tall. The user may collapse the container 10 such that only two of the three sidewall portions 15*a* are exposed or only 6 inches of sidewall 15 is exposed. In this manner, the total amount of sidewall 15 available to pass light is decreased. In addition, because the sidewall portions 15*a* fold in on one another via flexible member 16, as the container 10 is collapsed, the thickness of at least a part of the sidewall 15 is increased further limiting the amount of light that will be able to pass through the sidewall 15. In accordance with one aspect of the technology, one or more magnets are disposed within the top or about the top of the upper casing 25. In this manner, the container 10 may be secured to a horizontal or vertical surface. One or more magnets may also be located in the lower casing 20 to facilitate securement to other surfaces.

In this operational configuration (extended with light directed to internal volume of container), the user need not place the container 10 such that its opening is occluded. Rather, the container 10 may be placed with its bottom surface in contact with a ground surface wherein the light illuminates the internal volume of the container 10. In another aspect, where the container 10 is usable as a spotlight (see, e.g., FIG. 5), the open top side of the container 10 is not occluded. Rather, the internal sides of sidewall 15 acts as a reflector that directs light emanating from the LED(s) 51 in a field of view that is at least partially limited by the sidewalls 15 of the container 10. In one aspect of the technology, the internal sides of the sidewall 15 are reflective or are coated with a reflective material (e.g., silver mylar or white plastic) to enhance the ability of the container 10 to act as a spotlight by reflecting more of the light emanating from LED(s) 51 out of the open end of the container 10. In one aspect, the sidewalls 15 are not necessarily reflective, but are colored and/or have a thickness that does not pass a significant amount of light therethrough.

Figure 6:
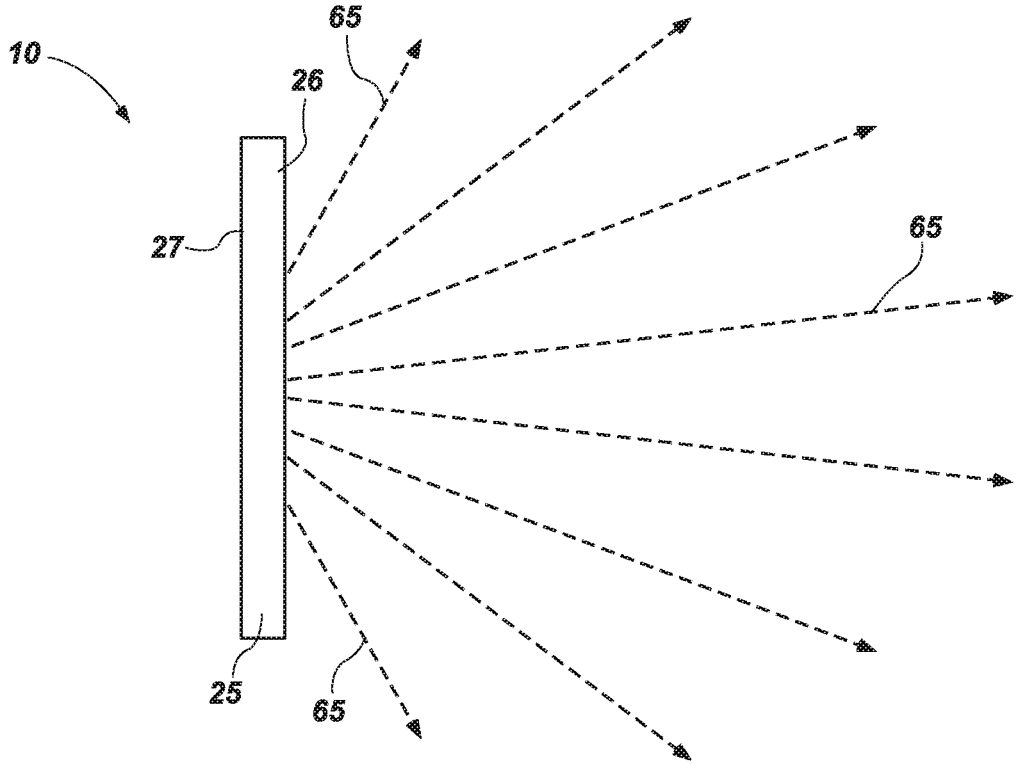
FIG. 6 is a side view of a collapsible container in a collapsed configuration in accordance with one aspect of the technology.

In another aspect of the technology, with reference to FIG. 4, when the container 10 is in an extended state, the disk 50 is configured such that the LED(s) 51 direct light downward 55 and away from an internal volume of the container 10. In this operational state, when the user is carrying the container 10 or the container is otherwise used or placed above another surface, light emanating from LED(s) 51 illuminates an area beneath the container 10. In yet another aspect of the technology, when the container 10 is in a completely collapsed state, the container 10 may operate as a flood light as shown in FIG. 6. Meaning, the light 65 emanating from LED(s) 51 is no longer confined, impeded, or directed by sidewalls 15 or is otherwise coupled to an "extended" container. Rather, the container 10 is in a substantially flat arrangement such that the casings have a substantially coplanar top 26 and/or bottom 27, with the LED(s) 51 located in the center of the casings and operable as a flood light.

In one aspect of the technology, disk 50 comprises a single magnet or a plurality of magnetic attachments that couple the disk 50 to lower casing 20. On a first side lateral, disk 50 comprises a power switch 54. On a second side (i.e., a top side), disk 50 comprises one or more LED(s) 51. The disk 50 is reversibly placed within the internal perimeter or boundary of lower casing 20 such that it may be faced "upward" or "downward" relative to the axially extending sidewall 15 as described herein. That is, the disk 50 may be placed such that the LED(s) 51 directs light "upward" into the volume of the container 10 as shown in FIG. 3 or reversed and oriented to direct light "downward" and away from the internal volume of the container as shown in FIG. 4. While magnetic attachments are specifically referenced, it is understood that many other temporary attachment arrangements may be used to accomplish the same objective of reversibly changing the orientation of the disk 50 within the lower casing 20 (e.g., clips, tab and groove, or frictional engaging surfaces). In one aspect of the technology, the disk 50 comprises a plurality of tabs 66 disposed on top lateral side surfaces of the disk 50 and tabs 67 disposed on bottom lateral side surfaces of disk 50. The tabs 66, 67 are configured to engage grooves or slots in the bottom of the container 10 (within lower casing 20 or otherwise). When light from LED(s) 51 is desired to be propagated in one direction (e.g., into an interior volume of container 10, etc.) tabs 66 are engaged in the grooves. When it is desired to reverse the direction of light propagated from disk 50, the tabs 66 are disengaged from the grooves or slots, the disk is turned over, and tabs 67 are engaged in the grooves.

In another aspect of the technology, disk 50 is equipped with one or more LED(s) 51 (i.e., an LED assembly) on opposing sides of disk 50 so that the disk 50 does not need to be reversed in order to propagate light in different directions. While a single power switch 54 is disclosed in the drawings, it is understood that the disk 50 may have a power switch 54 on different sides that controls one or both of the LED(s) 51 in the aspect where one or more LED(s) are disposed on opposing or differing sides of the disk 50. In one aspect of the technology, a first power switch 54 is disposed on a first side of the disk 50 and is operably connected to one or more LED(s) 51 disposed on an opposing side (i.e., a second side) of disk 50 or the side of the disk 50 that is opposite the first power switch 54. A second power switch is disclosed on the second side of disk 50 and is operably connected to one or more LED(s) 51 (i.e., an LED assembly) disposed on the first side of disk 50. In other words, a corresponding power switch is disposed on a side of the disk 50 opposite the side of the LED(s) that is controlling.

However, in one aspect, each power switch can control one or both of the LED assemblies or a single power switch 16 located on a side surface of the disk can control the different LED assemblies. In one aspect of the technology, the LED assembly comprises a chip-on-board LED, though other LED assemblies are contemplated for use, including separate LED chips operably coupled together on the same side of the disk 50.

In one aspect of the technology, the disk 50 comprises a housing 70 with a lid 71 configured to threadably couple 72 to the housing 70, though other means of attachment are contemplated and known. The housing 70 comprises a battery compartment 73 coupled to the LED(s) 51 and the power switch 54. A lens 75 is disposed about a top surface of the LED(s) 51 within an opening on the top of the housing 70.

In one aspect of the technology, a clear or translucent window is disposed within a bottom portion (e.g., within the lower casing 20) of the collapsible container 10. When the collapsible container 10 is in an extended state or configuration, the transparent window forms a water tight separation between the disk 50 (or at least a portion of lens 75) and an upper or internal volume of the collapsible container 10. In this manner, fluids or other materials carried within the volume of the extended (but collapsible) container 10 will not encumber and possibly damage the disk 50.

In a related example, a method for operating a lighting device is disclosed. The method comprises operating a collapsible container 10 having a lighting device disposed on a bottom of the container 10. The collapsible container 10 comprises a plurality of sidewall portions forming a continuous water-tight sidewall connected to an upper casing 25 and a lower casing 20. The sidewall portions have decreasingly smaller diameters from top to bottom and fold in on each other as the upper casing 25 is moved downward over the lower casing 20. The diameter of the upper casing 25 is greater than the diameter of the lower casing 20. When in a collapsed configuration, the lower casing 20 (as well as the disk 50) fits within the inside perimeter of the upper casing 25 to form a nest. In this configuration, the top and/or bottom portions of the upper casing 25 and lower casing 20 are substantially coplanar.

The method comprises extending and closing the container 10 for a variety of different uses. For example, in one aspect of the technology, the method comprises extending the container 10 into an open configuration creating an open volume or internal volume in an inner space between the sidewall 15. It further comprises operating a lighting device 50 disposed about a bottom of the container 10 in a first configuration wherein the lighting device propagates light in a first direction that is upward and into the open volume. It further comprises a second configuration wherein the lighting device propagates light in a second direction, opposite the first direction, downward and away from the open or internal volume of the container 10. In one aspect, the method comprises arranging the container such that the top casing is in contact with a flat opaque surface and propagating light into the open volume within the sidewall 15 creating an area light by diffusing light through the sidewall 15. The method further comprises partially closing or collapsing the container 10 to lessen the surface area of the sidewall 15 and/or increasing the thickness of the sidewall 15 thereby decreasing the amount of light diffused through the sidewall to the surrounding area. In another aspect, the method comprises directing the upper casing 25 in a direction towards a target area that the user wishes to illuminate and propagating light from the lighting device 50 towards the target area. The method further comprises propagating light beneath the container, when the container 10 is in an extended state. The method also comprises collapsing the container so the lighting device is substantially flush with the top surface of the collapsed container 10 and propagating light from the collapsed container wherein the light is substantially unencumbered from the sidewalls 15.

It is noted that no specific order is required in these methods unless required by the claims set forth herein, though generally in some embodiments, the method steps can be carried out sequentially.

Of course, it is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A collapsible lighting device, comprising:

a plurality of interconnected concentric rings, wherein each of the plurality of interconnected concentric rings has a different radius, wherein each one of the plurality of interconnected concentric rings is connected to at least one other ring by a flexible membrane;

wherein a one of the plurality of concentric rings having a radius smaller than the other of the plurality of concentric rings comprises an adjustable light source disposed within an internal perimeter of the one of the plurality of concentric rings having a radius smaller than the other of the plurality of concentric rings;

wherein said adjustable light source comprises a first configuration and a second configuration, the first configuration comprising an orientation where the light source propagates light in a first direction that is concentric with the plurality of concentric rings and a second direction that is concentric with the plurality of rings and opposite the first direction.

2. The lighting device of claim 1, wherein the adjustable light source comprises a disk having an LED disposed about a first side of the disk and a power switch disposed about a second side of the disk.

3. The lighting device of claim 1, wherein a one of the plurality of concentric rings having a radius larger than the other of the plurality of concentric rings comprises a handle coupled at diametrically opposed portions of the one of the plurality of concentric rings having a radius larger than the other of the plurality of concentric rings.

4. The lighting device of claim 1, wherein the one of the plurality of concentric rings having a radius smaller than the other of the plurality of concentric rings comprises at least one magnet disposed about a bottom portion the one of the plurality of concentric rings having a radius smaller than the other of the plurality of concentric rings.

5. The lighting device of claim 1, further comprising a water-tight translucent window extending across a portion of an internal perimeter of at least one of the plurality of concentric rings.

6. The lighting device of claim 1, wherein the plurality of concentric rings are rigid or semi-rigid.

7. The light device of claim 1, wherein when the light source is in a first configuration, a bottom surface of the light source is coplanar with a bottom surface of the one of the plurality of concentric rings having a radius smaller than the other of the plurality of concentric rings.

8. The lighting device of claim 1, wherein the plurality of concentric rings and flexible membrane form a water-tight container.

9. A collapsible light device, comprising:

a plurality of concentric casings coupled together by a flexible membranes forming sidewalls, wherein each casing has a different sized perimeter, the plurality of casings having a first configuration and a second configuration;

wherein the first configuration comprises a collapsed configuration wherein each of the plurality of concentric casings form a nested group of concentric casings and wherein the second configuration comprises an extended configuration wherein the plurality of concentric casings and sidewalls define an internal volume having (i) translucent continuous sidewalls, (ii) an open end, and (iii) a closed end;

a light source disposed in a one of the plurality of concentric casings having a perimeter smaller than the other of the plurality of concentric casings, wherein in a first configuration the light source propagates a majority of light unimpeded by the sidewalls and in a second configuration the light source propagates a portion of light that is reflected off the sidewalls and a portion of light that passes through the sidewalls.

10. The collapsible light device of claim 9, wherein when the lighting device is in the second configuration, the light source is disposed about the closed end.

11. The collapsible lighting device of claim 10, the second configuration comprises an occluded orientation and a not-occluded orientation, wherein when the device is in the occluded orientation, the open end of the lighting device is occluded.

12. The collapsible lighting device of claim 11, wherein when the open end of the lighting device is occluded, the amount of light propagated through the translucent sidewalls is greater than when the lighting device is in a not-occluded orientation.

13. The collapsible lighting device of claim 11, wherein when the lighting device is in an occluded orientation, it acts as a lantern and when the lighting device is in a not-occluded orientation is acts as a spot-light.

14. The collapsible lighting device of claim 9, wherein the light source comprises a disk having a first configuration and a second configuration, the first configuration comprising an orientation wherein the light source propagates light in a first direction that is concentric with the plurality of concentric casings and a second direction that is concentric with the plurality of casings and opposite the first direction.

15. A method of illumination, comprising:

obtaining a lighting device comprising a plurality of concentric casings coupled together by a flexible membrane, wherein each casing has a different perimeter and wherein a light source is disposed in a one of the plurality of concentric casings having a perimeter smaller than the other of the plurality of concentric casings;

positioning the lighting device in a first configuration, wherein the first configuration comprises a collapsed configuration wherein each of the plurality of concentric casings form a nested group;

positioning the lighting device in a second configuration, wherein the plurality of concentric casings are in an extended configuration forming a water-tight internal volume having (i) a continuous sidewall, (ii) a closed bottom, and (iii) an open top; and propagating light from the light source into the internal volume when the lighting device is in the second configuration.

16. The method of claim 15, further comprising propagating light from the light source in a direction opposite the internal volume when the lighting device is in the second configuration.

17. The method of claim 15, further comprising occluding the open top of the lighting device when in the second configuration and propagating light from the light source into the internal volume.

18. The method of claim 15, further comprising propagating light from the light source while the lighting device is in the first configuration.

19. The method of claim 18, further comprising hanging the light source by a handle located on one of the plurality of interconnected casings.

20. The method of claim 15, further comprising hanging the light source by a handle located on one of the plurality of interconnected casings.

* * * * *